US005213931A

United States Patent [19]

Staples et al.

[11] Patent Number: 5,213,931

[45] Date of Patent: May 25, 1993

[54] METHOD AND MEANS FOR HYDRAULIC MENISCUS TONING OF FERRO ELECTRIC MATERIALS

[75] Inventors: Phillip E. Staples, Warradale; Luis Lima-Marques, Henley Beach, both of Australia

[73] Assignee: Man Roland Druckmaschinen AG, Offenbach am Main, Fed. Rep. of Germany

[21] Appl. No.: 697,106

[22] Filed: May 8, 1991

[30] Foreign Application Priority Data

May 24, 1990 [AU] Australia ..... PK0308

[51] Int. Cl.[5] ..... G03G 13/10

[52] U.S. Cl. ..... 430/102; 430/117

[58] Field of Search ..... 430/102, 117

[56] References Cited

U.S. PATENT DOCUMENTS 4,021,586 5/1977 Matkan ..... 430/117

4,268,597 5/1981 Klavan et al. ..... 430/117

*Primary Examiner*—Marion E. Mc Camish

*Assistant Examiner*—Mark A. Chapman

*Attorney, Agent, or Firm*—Frishauf, Holtz, Goodman & Woodward

[57] ABSTRACT

To predispose toner particles to develop latent images in the form of polarized domains on a ferro-electric recording layer (12), for immediate transfer to a substrate (S), a donor roller (1) is rotated in a bath of liquid dispersed toner particles (4), which are charged; the thickness of the liquid dispersion, and hence of the quantity of donor particles, is controlled by limiting the amount of dispersant liquid toner particle deposit by rotating a limiting roller (9) positioned spaced apart with respect to said donor roller by a tiny gap; sequential rotation of the donor roller past a nkp (14) with the ferro-electric surface layer (12) forms a meniscu between the toner dispersion and, where the polarization of domains of the ferro-electric recording member (12) is opposite the charge polarization of the toner particles, the toner particles will adhere to the ferro-electric recording surface (12) for subsequent transfer to the recording substrate (S).

14 Claims, 1 Drawing Sheet

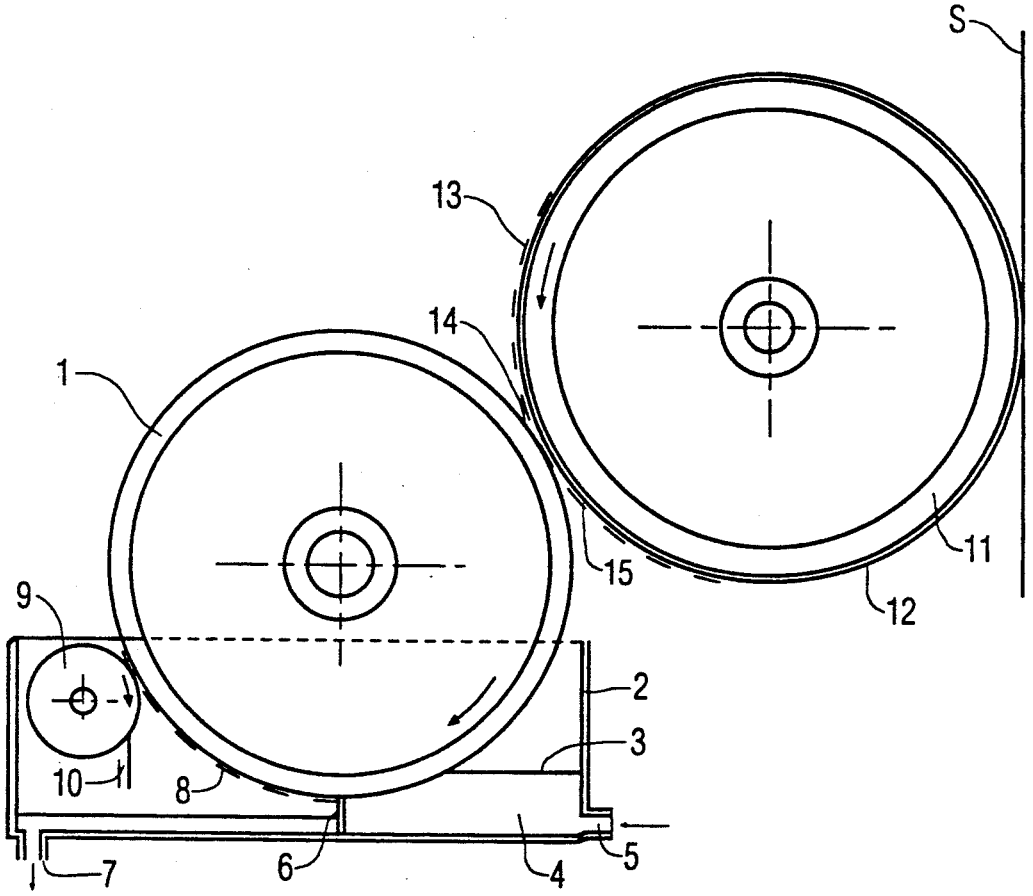
S
13
14
1
11
15
12
9
2
3
10
8
7
6
4
5

METHOD AND MEANS FOR HYDRAULIC MENISCUS TONING OF FERRO ELECTRIC MATERIALS

BACKGROUND OF THE INVENTION

Electrostatic printing is a well known printing process in which an electrostatic latent image is made to attract electrostatic marking particles, so called toner. The toner can be of the dry type or of the liquid type. Electrostatic printing is particularly applicable when only a relatively small number of prints are required, or when the subject matter is frequently changed, or when part of the subject matter needs to be sequentially changed.

Dry powder toners have many disadvantages when used in such a process. The main objection are related to the dusting problem; dust, or fine, or small particles of toner are prone to escape from the developer, and these deposit onto any surface both within and outside the printing device, causing mechanical failures within the device and environmental problems outside the device. This problem becomes severe when such printing devices are run at high speed. Other disadvantages include, cost of the general maintenance of the press and cost of the dry powder toner.

Liquid electrostatic printing also has a number of objectionable problems, especially when these devices are required to operate at high speed. The main problem is in regard to the solvent carry-out. The term solvent carryout relates to the quantity of solvent or carrier which is trapped within the paper and mechanically removed from the toner applicator. Such solvent subsequently evaporates, giving rise to atmospheric pollution and also adding significantly to production costs. A further disadvantage of liquid toning is the tendency for deposition of colouring matter in non-image or background areas which results in a general discolouration of the copy, normally referred to as background fog.

Various methods have been proposed to reduce solvent carry-out and background fog. Of these methods the most significant appears to be that disclosed in U.S. Pat. No. 4,268,597 of Klavan et al, in which a thin layer of liquid dispersed toner is formed at a development zone, and the surface on which a physical material image is to be formed is disposed close to but out of contact with the toner dispersion at the development zone. The electrostatic field associated with the latent image on the surface causes a change of shape of the surface of the layer of liquid dispersed toner in the form of pseudopods which are conjointly in the shape of portion of the latent image. The pseudopods contact the latent image bearing surface in the image areas only causing toner deposition in the image areas only.

Klavan et al disclose many mechanisms for formation of a thin layer of liquid dispersed toner at the development zone. However no attempt is made to pre-dispose the toner particles to develop the latent image on the surface to be toned, the developing member being partially immersed in a body of liquid dispersed toner and subsequently rotated against a doctor blade or roller or series of rollers to produce a dispersed toner layer of the desired thickness at the development zone.

THE INVENTION

It is an object to predispose the toner particles to develop the latent image on a ferroelectric recording member having domains polarized in accordance with an image, while at the same time limiting the thickness of the toner layer on the developing member or donor roller.

The present invention is particularly adapted to the repeat toning of latent images contained on or about the surface of cylindrical ferro-electric recording members.

Briefly, the printing device of the invention comprises a ferro-electric cylinder about which is positioned a means of developing the latent image on said cylinder with a liquid toner, and a means of electrostatically transferring the toner from the ferro-electric cylinder to paper. The developing means is positioned and arranged to limit the amount of dispersant or carrier liquid of the toner which transfers to the surface of the ferro-electric layer.

The ferro-electric cylinder comprises an electrically conductive cylinder having on its outer surface a layer of ferro-electric material in contact therewith. In operation this cylinder rotates as will be described in the following.

The ferro-electric material has a permanent latent image impressed on or about its surface by way of internal polarization. This polarization may be of the positive type, wherein positively charge toner particles are repelled, or of the negative type, wherein positive toner particles are attracted, or a combination of both types of polarization.

The developing means, which is the specific subject of the present invention, consists of a roller, (so called donor roller) which transports the toner from the reservoir to the surface of the ferro-electric material, a mechanism for pumping the toner from a holding tank to this reservoir and returning the excess to the holding tank, a coronode which acts as the wall of this reservoir, to which an electrical potential is applied so that toner particles are made to deposit onto the donor roller, and finally a means of limiting the quantity of dispersant on the donor roller.

Paper, in the form of a web is transported such that the toned image is electrostatically transferred to it, by such means that the so formed image is not distorted or deformed in any appreciable manner. Thereafter the toner is fixed to the paper merely by action of dispersant evaporation which can be aided by the application of heat in the form of infra-red radiation, or the like if so desired.

The liquid toner for such a device must be of a specific formulation or type such that it will readily deposit onto the before mentioned donor roller, be formed into a hydraulic meniscus between the donor roller and the ferro-electric material, such that toner or part thereof is transported to the ferro-electric cylinder, in such a manner, so as to tone the latent image corresponding to the polarization, substantially without contacting background or non-image areas.

The present invention relates to the ability of the said toner to form a meniscus by hydraulic means such that complete toning of the ferro-electric can be accomplished virtually instantaneously, with a minimum of contact between the toner and the ferro-electric material, resulting in virtually fog free images with little loss of carrier or dispersant.

Formation of the meniscus is readily obtained by the correct selection of donor roller material, surface smoothness, and diameter, for the desired speed of operation. The application of a potential difference between the ferro-electric cylinder and the donor roller also aids in the control of the formation of a meniscus of the desired type. In particular, changes in this potential affect the quantity of toner which can be attracted to the latent image without adversely affecting the fog, or background of the resulting transferred image. In addition, the quantity of toner present on the donor roller is controlled by a second roller, or a doctor blade, or the like. Accordingly, the optimum ratio of active toner particles to carrier liquid or dispersant for any desired speed can be easily obtained by appropriate adjustment of the potential difference between the donor roller and the coronode.

Excellent image quality has been obtained with printing speeds up to 3.0 m/sec. Even at this speed, so called solvent carryout is virtually nil when operating under optimum conditions. Excellent image reproduction can be obtained when the gap between the ferro-electric material and the donor roller is in the range 0.1 to 1.5 mm, however, the preferred range is from 0.25 to 0.35 mm. Coronode/donor roller potential differences of 50 to 1,500 volts yield good results, but the preferred range is from 100 to 500 volts. The potential differences between the ferro-electric and the donor roller is in the range of 0 to 1,000 volts, however, optimum image quality is obtained in the range 200 to 500 volts. Using a second roller, which is made to rotate such that it acts to limit the quantity of toner on the donor roller, a gap of from 0.10 to 0.50 mm allows the hydraulic meniscus to form between the donor roller and the ferro-electric material, In particular, a gap of 0.20 to 0.30 mm is preferred.

The toner which is applicable to this invention is not restricted to either aqueous based or hydrocarbon based formulations. However, an appropriate toner has been disclosed in our U.S. application Ser. No. 07/669,510 filed Mar. 14, 1991. Although this is a hydrocarbon based toner, aqueous toners have also yielded excellent results.

This method of toning is applicable to a wide variety of ferro-electric ceramic materials. Calcium titanate barium titanate, lead titanate zirconate, lead strontium titanate zirconate, lead metaniobate, sodium niobate and sodium metaniobate are preferred.

THE DRAWING

The single Figure illustrates the preferred configuration of the toning unit of the present invention.

Referring to FIG. 1. in detail, donor roller 1, is mounted above toner tank 2, and arranged to rotate in the direction shown by way of drive means not shown. Toner dispersion 3, containing dispersed toner particles 4, is pumped into toner tank 2 through inlet 5 from a reservoir not shown. Toner dispersion 3 is generally contained in toner tank 2 by coronode 6, which is electrically insulated from toner tank 2 but forms one side of enclosure which limits toner contact to that section of donor roller 1 which is behind coronode 6. Excess toner dispersion 3 is returned to the reservoir through outlet 7.

When toner tank 2 is filled as shown with toner dispersion 3 and a DC voltage is applied to coronode 6 simultaneously with rotation of donor roller 1 in the direction shown, a layer of liquid dispersed toner 8 is formed on the surface of donor roller 1, the density of toner particles 4 contained in layer of liquid dispersed toner 8 being dependant on the voltage applied to coronode 6 and the speed of rotation of donor roller 1.

Solvent limiting roller 9 is mounted in the position shown in relation to donor roller 1, spaced apart from donor roller 1 the required distance to limit the layer of liquid dispersed toner 8 on donor roller 1 to the desired thickness. Doctor blade 10 removes toner dispersion on solvent limiting roller 9 and returns such dispersion to toner tank 1.

Conductive roller 11 containing ferro-electric layer 12 in ohmic contact thereon is mounted as shown in a position spaced apart from donor roller 1. Ferro-electric layer 12 carries electrostatic latent image 13 on its outer surface. At toning gap 14 electroscopic marking particles 4 transfer from donor roller 1 to electrostatic latent image 13 to form toned image deposit 15 on the surface of ferro-electric layer 12.

The toned image can be transferred to a receiving substrate S, typically paper.

DESCRIPTION OF THE PREFERRED EMBODIMENT

In the preferred embodiment of this invention the toning unit as disclosed is used for repetitive toning of the latent image contained on or about the surface of the ferro-electric recording member, in an electrostatic printer. Such a device may be required to operate at relatively high printing speeds, such as up to 4 meters/-second. For this purpose we have found it highly desirable that the donor roller should be of relatively large diameter, which is contrary to prior art teaching. Thus, when the ferro-electric layer is contained on a conductive roller which is 220 mm diameter, it has been found advantageous to use a donor roller which is 200 mm diameter. Normally each of these rollers rotates at substantially the same peripheral speed. The donor roller surface is preferably smooth.

The solvent limiting roller is spaced apart from the donor roller, a preferred gap being 0.1 mm. This roller is 50 mm diameter, and resolves at a speed of up to 4000 rpm, usually 2000 rpm. As can be seen on the drawing this roller rotates in a direction to hold back liquid dispersant on the surface of the donor roller.

As previously stated the coronode/donor roller potential difference may vary between 50 and 1500 volts, the preferred range being 100–500 volts. It is preferable that the full voltage should be applied to the coronode, the donor roller being grounded. This is to prevent distortion of the electrostatic latent image on the ferro-electric recording member. When the latent image on the ferro-electric recording member is of negative polarity the voltage applied to the coronode would be of positive polarity.

The method of impressing the latent image on the ferro-electric recording member and of maintaining same is not part of this invention, however we have found that it is possible to maintain a potential difference between the latent image on the ferro-electric recording member and the donor roller of up to 1000 volts. However as previously stated optimum image quality is obtained when this potential difference is within the range 200–500 volts. The preferred gap between the donor roller and the recording member surface is 0.20 to 0.30 mm, as previously stated.

We claim:

1. A method for toning a latent image contained on the surface of a ferro-electric recording member (12) disposed in ohmic contact on the outer surface of a conductive roller (11), said method comprising the steps of coating a controlled quantity of toner particles (4) by electro-deposition on the surface of a donor roller (1), said toner particles being contained within a liquid dispersion (3), sequentially limiting the amount of dispersant liquid contained with and within said toner particle deposit on said donor roller by rotation of a limiting roller (9) positioned in a spaced apart relationship with said donor roller to thereby control the thickness of the controlled density toner layer on said donor roller; and causing said latent image on said ferro-electric recording member (12) to selectively form menisci on said toner layer coated on said donor roller (1) to allow toner particles to contact said ferro-electric recording member (12) only in the latent image bearing areas thereof by sequentially rotating said donor roller (1) to advance said controlled thickness and controlled density toner layer on the surface of said donor roller to a position adjacent to said conductive roller (11) containing said ferro-electric recording member (12) on said surface thereof but in a spaced apart relationship therewith.

2. A method for toning a latent image contained on the surface of a ferro-electric recording member as disclosed in claim 1, further characterised by pumping said liquid dispersion containing said toner particles into a toner tank (2) beneath said donor roller.

3. A method for toning a latent image contained on the surface of a ferro-electric recording member as disclosed in claim 2, further characterised by charging said toner particles by means of a coronode (6) which is located in the toner tank (2), electrically insulated from all other components of said toner tank.

4. A method for toning a latent image contained on the surface of a ferro-electric recording member as disclosed in claim 3, further characterised by the application of DC voltage within the range 50 to 1500 volts to said coronode.

5. A method for toning a latent image contained on the surface of a ferro-electric recording member as disclosed in claim 1, further characterised in that said limiting step comprises rotating said limiting roller (9) in a direction counter to that of said donor roller (1), at a speed up to 4000 rpm.

6. A method for toning a latent image contained on the surface of a ferro-electric recording member as disclosed in claim 1 further characterised by said limiting roller being spaced apart from said donor roller a distance of about 0.1 mm.

7. A method for toning a latent image contained on the surface of a ferro-electric recording member as disclosed in claim 1, further characterised said ferro-electric recording member being spaced apart from said donor roller a distance within the range 0.20 to 0.30 mm.

8. A method for toning a latent image contained on the surface of a ferro-electric recording member as disclosed in claim 1, further characterised by the potential difference between the latent image on the ferro-electric recording member and the donor roller being within the range 100 to 500 volts.

9. A method for toning a latent image contained on the surface of a ferro-electric recording member as disclosed in claim 1, further characterised by said donor roller (1) and said conductive roller (11) having said ferro-electric recording member (12) being rotated at substantially the same peripheral speed.

10. A method for toning a latent image contained on the surface of a ferro-electric recording member as disclosed in claim 1, further characterised by the diameter of said donor roller being about 90% of the diameter of said conductive roller containing said ferro-electric recording member.

11. A method for toning a latent image contained on the surface of a ferro-electric recording member as disclosed in claim 1, further characterised by said toner deposit on said ferro-electric surface (12) being transferred to a receiving member(s) and said sequence of events disclosed in claim 1 being repeated at least once without renewal of said latent image on said ferro-electric recording member.

12. Printing apparatus comprising a printing plate cylinder (11) having a surface (12) which comprises at least in part, a layer of ferro-electric material having ferro-electric domains which are polarized in accordance with image information; and means for applying charged toner particles on said ferro-electric surface for, selectively, adhesion of charged toner particles, or repulsion of charged toner particles from said surface in accordance with the relative charge polarity of the toner particles and the polarity of the domains of said ferro-electric surface, said application means comprising a donor roller (1) positioned with respect to the printing cylinder to define a narrow toner transfer nip (14);

a toner receptacle (2), said donor roller (1) receiving toner particles from said toner receptacle;

charge means (6) for electrostatically charging toner particles within said toner receptacle, said toner particles electrostically adhering to the surface of the donor roller (1); and toner thickness control means (9) positioned with respect to the surface of the donor roller (1) to control the thickness of toner particles remaining on the surface of the doner roll (1) and available for transfer, upon rotation of the donor roller (1) past said nip (14) to the surface (12) of the printing plate cylinder having the ferro-electric domains, in accordance with the relative polarization of the ferro-electric domains and the charge of the toner particles.

13. The apparatus of claim 12, wherein said donor thickness control means comprises a limiting roller (9) positioned in spaced-apart relationship with respect to said donor roller (1) by a small gap (14).

14. The apparatus of claim 13, wherein said limiting roller (9) rotates in a direction opposite to the direction of rotation of said donor roller (1).

* * * * *